US005427703A

United States Patent [19]

Grandvallet et al.

[11] Patent Number: 5,427,703

[45] Date of Patent: Jun. 27, 1995

[54] PROCESS FOR THE PREPARATION OF POLAR LUBRICATING BASE OILS

[75] Inventors: Pierre Grandvallet; Daniel G. P. Allais; Roland A. C. Garin, all of Grand Couronne, France

[73] Assignee: Shell Oil Company, Houston, Tex.

[21] Appl. No.: 71,428

[22] Filed: Jun. 2, 1993

[30] Foreign Application Priority Data

Jul. 17, 1992 [EP] European Pat. Off. ..... 92402068

[51] Int. Cl.[6] ..... C10M 109/02; C10M 133/58; C10M 135/02

[52] U.S. Cl. ..... 252/51.5 A; 252/51.5 R; 252/52 R; 252/56 R; 252/45; 252/47; 252/47.5; 252/50; 252/51; 252/48.2; 252/49.7; 252/49.9; 252/9

[58] Field of Search ..... 252/45, 46.3, 46.4, 252/46.7, 47, 47.5, 48.2, 48.4, 48.6, 50, 51, 51.5 A, 51.5 R, 52 R, 54.6, 56 R, 32.7 R, 32.7 E, 32, 33, 9, 49.7, 49.9

[56] References Cited

U.S. PATENT DOCUMENTS

| | | | |
|---|---|---|---|
| 3,219,666 | 11/1965 | Norman et al. . | |
| 4,021,334 | 5/1977 | Gorring et al. | 252/45 |
| 4,440,659 | 4/1984 | Chen et al. | 252/51.5 A |
| 5,242,609 | 9/1993 | Van Zan et al. | 252/33.6 |

FOREIGN PATENT DOCUMENTS

| | | |
|---|---|---|
| 346999 | 12/1989 | European Pat. Off. . |
| 383395 | 8/1990 | European Pat. Off. . |
| 3220995 | 12/1983 | Germany . |
| 1429494 | 3/1976 | United Kingdom . |
| WO89/12663 | 12/1989 | WIPO . |
| WO89/12670 | 12/1989 | WIPO . |
| WO90/12857 | 11/1990 | WIPO . |

OTHER PUBLICATIONS

Kirk-Othmer "Encyclopedia of Chemical Technology," 3rd edition, vol. 14, pp. 477-526, 1981.

*Primary Examiner*—Prince Willis, Jr.
*Assistant Examiner*—Alan D. Diamond
*Attorney, Agent, or Firm*—Timothy J. Hadlock

[57] ABSTRACT

Process for the preparation of a polar lubricating base oil, including reacting a hydrocarbonaceous product with a polar compound, including at least one heteroatom and which hydrocarbonaceous product has been prepared by contacting hydrocarbons and/or derivatives thereof with an active-hydrogen containing system by a process which includes generating a hydrogen-containing plasma and allowing contact of the hydrocarbons and/or derivatives thereof in liquid form with the plasma-generated system and recovering the hydrocarbonaceous product.

15 Claims, No Drawings

PROCESS FOR THE PREPARATION OF POLAR LUBRICATING BASE OILS

FIELD OF THE INVENTION

The present invention relates to a process for the preparation of a polar lubricating base oil including a hydrocarbonaceous product prepared by contacting hydrocarbons and/or derivatives thereof with an active-hydrogen containing system. The present invention further relates to a process for the preparation of a functionalized lubricating base oil from the polar lubricating base oil, to the base oils prepared by these processes and to finished lubricants containing base oils prepared by these processes.

BACKGROUND OF THE INVENTION

Typically, finished lubricants include an additive package incorporating a variety of chemicals to improve or protect the properties of the lubricant during use in specific situations, particularly internal combustion engine and machinery applications. The more commonly used additives include oxidation inhibitors, rust inhibitors, metal passivators, anti-wear agents, extreme pressure additives, pour point depressants, detergent-dispersants, viscosity index improvers, foam inhibitors and the like. This aspect of the lubricant art is specifically described in Kirk-Othmer "Encyclopedia of Chemical Technology", 3rd edition, Vol. 14, pages 477–526.

Several drawbacks to the use of additives are the generally lower resistance to shearing, as compared with base oils and the generally larger tendency to decompose at the ever increasing average internal combustion engine temperature. Further, lubricating base oils, in particular extra high viscosity index lubricating base oils, are, because of their hydrocarbon structure, largely incompatible with polar additives. Accordingly, in order to provide stable blends of lubricating base oil and the additives, up to 25% by weight of expensive polar organic esters is added, such as pentaerythritol tetra-ester or trimethylolpropane tri-ester.

In the art there is a desire to reduce the amount of additives needed and to provide lubricating base oils which themselves possess advantageous properties. However, despite on-going research in this area, there is still a need for considerable improvement. It would be most advantageous to be able to provide lubricating base oils, in particular extra high viscosity index lubricating base oils, of a polar nature, which are compatible with polar additives, thus obviating the need for expensive polar organic esters, acting as blend stabilizers. In addition, it would be desirable to reduce the amount of additives needed and to be able to provide lubricating base oils possessing an extra high viscosity index and a high dispersancy, that is, the ability to solubilize and disperse other materials, for example materials resulting from oxidation reactions in commercial lubricants or fuel soot.

British Patent specification No. 1,429,494 discloses a process for the preparation of a lubricating base oil, which satisfies the SAE 10W/30 specification, without the addition of a polymeric viscosity index improver. European Patent Application publication No. 383 395 discloses the preparation of lubricating base oils having a high viscosity index of at least 125 and an increased aromaticity. An increase in aromaticity results in a higher ability to solubilize other materials, for example materials resulting from oxidation reactions which occur during the use of commercial lubricants.

European Patent Application Publication No. 346999 (EP 346999) of which U.S. Pat. No. 5,034,108 is an equivalent, discloses a process for the preparation of a lubricating base oil, including a hydrocarbonaceous product prepared by contacting hydrocarbons and/or derivatives thereof with an active-hydrogen containing system, which process includes generating a hydrogen-containing plasma at a pressure of at least 0.007 bar and allowing contact of the hydrocarbons and/or derivatives thereof in liquid form with the plasma-generated system and recovering the hydrocarbonaceous product.

For the purpose of this specification, a process such as disclosed in EP 346999 will hereinafter be referred to as a plasma-process. U.S. Pat. No. 5,034,108, to the extent it contains the disclosure of EP 346999, is hereby incorporated by reference. It will be understood that the hydrocarbonaceous product referred to throughout the specification is the product of a plasma-process. Derivatives as referred to in this specification are defined as hydrocarbons containing heteroatoms, such as sulfur, nitrogen and/or oxygen.

EP 346999 describes that it is possible to functionalize and oligomerize starting materials in the reactor of the plasma process by treating the starting materials with a hydrogen-containing plasma. By this process starting materials could be functionalized or oligomerized which heretofore could not be functionalized or oligomerized without, for example, a dehydrogenation step or without the aid of a free-radical generating catalyst. Examples of such materials include highly paraffinic mineral oils and kerosines.

A disadvantage of such plasma-process is that, while it is possible to prepare unique hydrocarbonaceous products of, for example, high viscosity, high viscosity index and low pour point, it is only possible to apply a limited number of starting materials due to the fact that not all starting materials are able to withstand the high amount of energy associated with the hydrogen-containing plasma. Thus, lubricating base oils containing certain polar groups and lubricating base oils possessing certain properties cannot be produced by the plasma-process. Accordingly, it would be most advantageous if a process could be found by which polar groups could be incorporated into the products of the plasma-process, without impairing the excellent properties possessed by these products.

It has now been found that the finished products, that is the hydrocarbonaceous products, of the plasma-process can be reacted directly, that is, without the aid of, for example, a free-radical generating catalyst, with certain polar compounds under reaction conditions to prepare a polar lubricating base oil. Moreover, it has surprisingly been found that the advantageous lubricating base oil properties of the hydrocarbonaceous product, such as a high viscosity, a high viscosity index (VI) and a low pour point, remain substantially unchanged, or are even improved.

SUMMARY OF THE INVENTION

The present invention therefore relates to a process for the preparation of a polar lubricating base oil, including reacting a hydrocarbonaceous product with a polar compound, including at least one heteroatom and which hydrocarbonaceous product has been prepared by contacting hydrocarbons and/or derivatives thereof with an active-hydrogen containing system by a process which includes generating a hydrogen-containing plasma and allowing contact of the hydrocarbons and/or derivatives thereof in liquid form with the plasma-generated system and recovering the hydrocarbonaceous product.

DETAILED DESCRIPTION OF THE PREFERRED EMBODIMENTS

Whenever in this specification reference is made to a polar compound, it is to be understood that this is a reference to a compound including at least one heteroatom and capable of reacting with the hydrocarbonaceous product. Without wishing to be bound by a particular theory, it would appear that especially those polar compounds having enophilic properties are preferred for use in the process of the present invention. For the purpose of this invention, a polar compound having enophilic properties is defined as a compound capable of reacting with a $C_{20}$-olefin.

Preferably, the polar compound includes one or more heteroatoms chosen from the non-metals of Group Va or VIa of the Periodic Table of the Elements, more preferably, nitrogen, sulfur and/or oxygen.

Preferably, the polar compound is chosen from the group of sulfur-containing compounds and/or a compound of one of the general formula (I) to (IV)

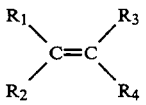

(I)

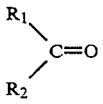

(II)

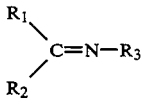

(III)

$R_1—C\equiv C—R_3$ (IV)

wherein $R_1$, $R_2$, $R_3$ and $R_4$, whenever present, each independently represents a heteroatom-containing group, hydrogen, alkyl, alkenyl, alkynyl, aryl or aralkyl, provided that in structures (I) and (IV) at least one of $R_1$, $R_2$, $R_3$ and $R_4$, whenever present, represents a heteroatom-containing group.

It will be appreciated by one skilled in the art that, when two of the groups $R_1$, $R_2$, $R_3$ and $R_4$ each represent a heteroatom-containing group, these two groups may be linked to form a cyclic structure.

Typically, any alkyl group ranges from $C_1$ to $C_{12}$ carbon atoms, preferably from $C_1$ to $C_8$ carbon atoms, especially from $C_1$ to $C_4$ carbon atoms. Any alkenyl or alkynyl groups typically range from $C_2$ to $C_{12}$ carbon atoms, preferably from $C_2$ to $C_8$ carbon atoms, especially from $C_2$ to $C_4$ carbon atoms. Any aryl or aralkyl groups may typically range from $C_5$ to $C_{12}$ carbon atoms, preferably from $C_5$ to $C_8$ carbon atoms, especially from $C_6$ to $C_8$ carbon atoms.

Preferably, the polar compound has the general formula (I) as hereinbefore defined. Preferred polar compounds for use in the process of this invention are compounds having the general formula (V):

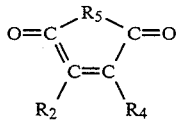

(V)

wherein $R_5$ represents oxygen or the group N-A, wherein A is hydrogen, alkyl, aryl, amino or polyamino, or compounds having the general formula (VI):

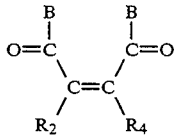

(VI)

wherein b represents hydrogen, alkyl, aryl, OH, $NH_2$, amino or polyamino, or the group O—D, wherein D represents alkyl, aryl, $NH_2$, amino or polyamino. More preferably, the polar compound is chosen from the group of maleic anhydride, maleic acid esters, amides or imides.

Preferred sulfur-containing compounds for use as the polar compound are elemental sulfur, thiols, sulfides, disulfides, polysulfides, thiophenes or compounds containing sulfur and other heteroatoms, such as cyclic structures including sulfur and nitrogen and/or oxygen, more preferably elemental sulfur, polysulfides or cyclic structures including sulfur and nitrogen and/or oxygen.

The hydrocarbonaceous product of unique structure and properties is prepared by a plasma-process as described above, using hydrocarbons and/or derivatives thereof as starting materials. Preferably the starting materials are selected from kerosine, gasoil or lubricating base oil and/or derivatives thereof. More preferably, the starting materials are selected from any lubricating base oil having a paraffinic and/or olefinic content of from 85% by weight. Suitable examples include (extra) high viscosity index mineral oils and polyolefins, such as poly-alpha-olefins and poly-isobutylenes. Preferably, the lubricating base oil has a viscosity index of at least 140, that is, an extra high viscosity index. The viscosity at 100 ° C. is preferably at least 4 cSt, more preferably from 4 cSt to 40 cSt.

In a particularly preferred embodiment the starting material is an extra high viscosity index lubricating base oil, preferably a mineral lubricating base oil, such as "XHVI" (trademark), a commercially available extra high viscosity index lubricating base oil.

The reaction conditions of the process of the present invention, especially the reaction temperature, may vary within wide limits. The reaction temperature to be applied is preferably up to at most 300° C. A higher reaction temperature may cause the formation of dark deposits and for that reason may be undesirable. Reaction temperatures below ambient temperatures will cause the reaction to proceed very slowly and are therefore undesirable. Accordingly, in a more preferred embodiment of the invention the reaction temperature is chosen in the range of from ambient to 300° C., in particular from 100° C. to 240° C.

Depending on the reaction temperature and the amount of polar compound to be reacted with the hydrocarbonaceous product, the reaction time may typically vary from 1 hour to 100 hours, preferably from 4 hours to 30 hours.

It will be understood that the amount of polar compound to be used in the reaction with the hydrocarbonaceous product depends, for example, upon the desired polarity of the polar lubricating base oil. Preferably, the reaction product includes up to 10% by weight, more preferably up to 5% by weight, of the polar compound, calculated on the basis of maleic anhydride.

Depending on the polar compound that is incorporated in the polar lubricating base oil, other properties of the base oil, such as dispersancy, detergency, oxidation stability or anti-wear properties, may have been altered. In one embodiment of the invention, the hydrocarbonaceous product from the plasma-process is reacted with a sulfur-containing polar compound as defined above to yield a polar base oil also having other advantageous properties, such as very good anti-wear properties, thus obviating the need for certain base oil additives.

In a further embodiment of the invention the hydrocarbonaceous product is first reacted with a polar compound as defined above to yield a polar base oil which may not possess other particularly advantageous lubricating base oil properties. The polar lubricating base oil may then be further reacted with a compound containing a moiety imparting functional properties to the base oil (hereinafter a "functional compound"), generally not having enophilic properties, to yield a functionalized base oil possessing such particularly advantageous lubricating base oil properties.

Although it is to be understood that a polar base oil may possess particularly advantageous ("functional") lubricating base oil properties and further reaction with a functional compound may not be desired, throughout this specification "polar lubricating base oil" refers to a hydrocarbonaceous product that has been reacted with a polar compound as defined above, whether or not possessing advantageous base oil properties. A polar lubricating base oil that has been further reacted with a functional compound shall be referred to as "functionalized lubricating base oil".

Preferably, the functional compound includes one or more heteroatoms, such as those selected from the nonmetals of Group Va or VIA of the Periodic Table of the Elements, more preferably, oxygen, sulfur and/or nitrogen.

In one embodiment of the invention, the functional compound includes a nitrogen atom. Preferred functional compounds including a nitrogen atom include functional compounds chosen from the group of amines, imines, hydrazines, hydrazones, amides or imides, more preferably amines such as, butylamine, ethanolamine, ethylene diamine, diethylene triamine, triethylene tetramine, tetraethylene pentamine, pentaethylene hexamine or 4-amino diphenyl amine, especially, polyamines.

The functional compound is most preferably selected from polyamines of the general formula (VII):

$$X_2N—[R_{(1\ to\ m)}—NX]_m—X \qquad (VII)$$

wherein each of $R_{(1\ to\ m)}$ is chosen from $C_nH_{(2n-2p)}$, wherein n ranges of from 1 to 10, p represents the degree of unsaturation and m ranges of from 2 to 10, X is hydrogen or $C_nH_{(2n-2p)}$, wherein at least one X is hydrogen, and/or a polyamine of the general formula (VII) containing one or more hydrocarbyl substituents up to 6 carbon atoms.

The degree of unsaturation may be defined as the amount of carbon-carbon double bonds present in the $C_nH_{(2n-2p)}$ groups in formula (VII). Thus, for an alkyl group the degree of unsaturation p equals 0 and for an alkenyl group p equals 1. It is to be understood that cyclic alkyl groups have a degree of unsaturation of 1 and a phenyl group has a degree of unsaturation of 4.

Preferably, n in formula (VII) ranges from 2 to 6, more preferably from 2 to 4. Preferably, m in formula (VII) ranges from 2 to 8, more preferably from 3 to 6. Typically, the polyamine of formula (VII) may include up to (2n-2p) hydrocarbyl substituents, replacing the 'H' in $C_nH_{(2n-2p)}$ of formula (VII). However, preferably, the polyamine of formula (VII) does not contain hydrocarbyl substituents. Preferably, at least two of X in formula (VII) represent hydrogen. More preferably, each X in formula (VII) represents hydrogen.

Preferably each of $R_{(1\ to\ m)}$ is an alkyl or cyclic alkyl group of n carbon atoms, wherein n represents a value as defined above. More preferably, each of $R_{(1\ to\ m)}$ is the same alkyl group.

In another embodiment of the invention, the functional compound includes a sulfur atom. Preferred functional compounds which include a sulfur atom include functional compounds chosen from the group of elemental sulfur, tiols, sulfides, disulfides, polysulfides or thiophenes, more preferably elemental sulfur or polysulfides.

In another embodiment of the invention, the functional compound includes an oxygen atom. Preferred functional compounds which include an oxygen atom include functional compounds chosen from the group of carboxylic acids, ketones, aldehydes, organic hydroxides, esters or ethers, more preferably esters.

In another embodiment of the invention, the functional compound includes at least two different heteroatoms, wherein one heteroatom is chosen from the group of nitrogen, sulfur and oxygen and the other heteroatom is chosen from the group of nitrogen, sulfur, oxygen, phosphorus, boron or a halogen. Preferred functional compounds include those chosen from the group of boric acids and esters, thioamines or thiadiazoles.

Preferably, the functional compound is linked to a polar lubricating base oil including a polar compound of one of the general formula (I) to (IV) as defined above, more preferably, a polar compound of the general formula (I), especially, a polar compound of the general formula (V) or (VI) as defined above. In a most preferred embodiment, the functionalized lubricating base oil includes a polar lubricating base oil, containing maleic anhydride as polar compound, and a polyamine functional compound linked to the polar lubricating base oil.

The reaction of the polar lubricating base oil with the functional compound is typically carried out at elevated temperature, preferably at a temperature up to 350° C., more preferably at a temperature of from 50° C. to 325° C. If desired, catalysts may be applied, but this is not a requirement as the reaction generally proceeds adequately without the aid of such a catalyst.

It has been found that certain lubricating base oil properties of the polar lubricating base oils and functionalized lubricating base oils discussed above, such as dispersancy, cleanliness and/or oxidation stability, can be further and significantly improved by treating the base oils with hydrogen at elevated temperature and pressure in the presence of a catalyst.

Further, it has been found that it is possible to select the treatment conditions in such a way that other properties of the polar or functionalized base oils remain substantially unchanged after treatment.

Preferably, the base oils are treated at a temperature of from 20° C. to 450° C., more preferably at a temperature of from 30° C. to 250° C. The products of the present invention may be treated under a relatively wide range of pressures. Preferably, the polar and functionalized lubricating base oils are treated at a hydrogen partial pressure of from 1 to 200 bar abs., more preferably at a hydrogen partial pressure of from 5 to 80 bar abs. Preferably, the base oils are provided at a space velocity of from 0.1 kg/l/h to 4.0 kg/l/h, more preferably at a space velocity of from 0.2 kg/l/h to 2.0 kg/l/h. The ratio of hydrogen to the polar or functionalized base oil may range from 100 to 5000 Nl/kg and is preferably from 250 to 2500 N/lkg.

The treatment (hydrogenation) may be carried out using any of catalyst bed arrangements known in the art, such as a fluidized bed, moving bed, slurry phase bed or a fixed bed. Preferably, a fixed catalyst bed is applied. It is to be understood that the reaction conditions, such as temperature, pressure and space velocity, may vary within the ranges specified hereabove according to the specific type of catalyst bed being used.

Any suitable hydrogenation catalyst may be used. Typically, the catalyst includes a catalytically active metal, selected from Group VIII and/or VIb of the Periodic Table of the Elements. Preferably, the catalyst includes a catalytically active metal selected from the group including cobalt, nickel, iron, platinum, palladium, molybdenum and tungsten. More preferably, the catalyst includes palladium.

As outlined above, both the polar and functionalized base oils may be hydrogenated in accordance with the process as described above. In case a functionalized base oil is to be hydrogenated, the hydrogenation treatment may be carried out either prior to or after reaction of the functional compound with the polar lubricating base oil. Preferably, the hydrogenation treatment is carried out prior to the reaction of the polar base oil with the functional compound.

The invention further relates to polar or functionalized lubricating base oils whenever produced according to a process as described above. Moreover, the invention relates to the use of the polar or functionalized lubricating base oil in finished lubricating oils, that is in blends with other base oils and/or lubricant additives.

The invention will now be further illustrated by means of the following Examples.

EXAMPLES

EXAMPLE 1

100 g. of a hydrocarbonaceous product, prepared by the plasma-process as disclosed in EP 346999, and having the properties as outlined in Table I, was reacted with 14.7 g. Maleic Anhydride (MALA) in a stainless steel vessel under 10 bar nitrogen pressure. The reaction was carried out at 210° C. for 10 hours. After cooling, excess MALA was removed by filtration of the oil diluted with iso-octane. The resulting polar lubricating base oil, containing 1.8% by weight of MALA, was further reacted with Tetraethylene Pentamine (TEPA) by slow addition of the polar lubricating base oil to a solution of TEPA in toluene. The reaction was carried out at a temperature of 50° C. for 1 hour, then at 150° C. until the solvent was removed. The resulting functionalized lubricating base oil had the properties as outlined in Table I. Both the functionalized base oil and the hydrocarbonaceous product were tested for dispersancy and oxidation stability properties by the following tests. Results of these tests are set out in Table I.

1. Carbon Black Dispersancy Test (CBDT) (British Rail publication BR 669:1984)

3% of carbon black is added to the oil and the increase in kinematic viscosity at 60° C. is determined, using an Ubbelohde viscometer. A low result indicates good performance.

2. Blotter Spot Test (BST Merit)

A drop of a mixture of 5% of an aged oil, containing ashes, and 95% of the oil being tested is applied to chromatography paper. When the total spot diameter is 32 mm, the ratio (*100) of the diameter of the black ashes-containing spot and the diameter of the total spot is determined. A high result indicates good performance.

3. Differential Scanning Calorimetry Test—Induction Period (DSC-IP)

The time elapsing (minutes) before onset of oxidation at 210° C. and atmospheric oxygen pressure of a sample (4 mg) of the oil being tested is measured, containing 1.0% wt. of a phenolic antioxidant. A high result indicates good performance.

TABLE I

| | Hydrocarbon. Product | Function. Base Oil |
|---|---|---|
| viscosity (100° C.) | 24.4 cSt | 32.1 cSt |
| viscosity ( 40° C.) | 211 cSt | 283 cSt |
| VI | 145 | 155 |
| Pour Point (°C.) | −15 | 18 |
| MALA content (% wt.) | — | 1.8 |
| TEPA content (% wt.) | — | 0.95 |
| CBDT | 51 | 15 |
| BST merit | 36 | 83 |
| DSC-IP | <10 | 38 |

It can be seen from the Table that the functionalized base oil has far better dispersancy properties, as measured in the Carbon Black dispersancy test and the Blotter Spot test, and a far better oxidation stability, as measured in the Differential Scanning Calorimetry test, than the hydrocarbonaceous product starting material. Moreover, it can be seen that the Viscosity Index (VI), the pour point and the viscosity have also been increased by the process of the present invention.

EXAMPLE 2

0.5 mole of a sulfur compound per mole of hydrocarbonaceous product was reacted in a stainless steel vessel under a nitrogen or hydrogen atmosphere at conditions given in Table II. Excess sulfur compound was removed by filtration. The hydrocarbonaceous product starting material had a viscosity at 100° C. of 26.8 cSt. Viscosities at 100° C. of the finished polar lubricating base oil are given in Table II.

TABLE II

| Experiments | 1 | 2 | 3 | 4 | 5 | 6 |
|---|---|---|---|---|---|---|
| Operating Conditions | | | | | | |
| Temperature (°C.) | 170 | 300 | 300 | 200 | 200 | 200 |
| Pressure (bar) | 1 | 18 | 54 | 50 | 20 | 50 |
| $N_2$ or $H_2$ atmosphere | $N_2$ | $N_2$ | $N_2$ | $H_2$ | $H_2$ | $N_2$ |
| reaction time (h) | 2.5 | 2.5 | 2.5 | 2.5 | 2.5 | 24 |
| sulfur compound | a | b | b | b | c# | b |

TABLE II-continued

| Experiments | 1 | 2 | 3 | 4 | 5 | 6 |
|---|---|---|---|---|---|---|
| Viscosity (100° C.) | 27.4 | 23.5 | 23.1 | 27.7 | 26.2 | 27.4 |

a = Mercapto thiadiazole
b = molten elemental sulfur
c = t-nonyl-pentasulfide
# = 0.02 mole sulfur per mole hydrocarb. product The products of experiments 2 and 5 of Table II, were tested for their anti-wear properties, using the 4-balls wearscar test. In-this test an upper ball is rotated at fixed speed under a given load of 40 kg for one hour on three fixed lower balls immersed in a bath of the oil being tested. After the test, the wearscar diameter on the lower three balls is measured. A low result indicates good anti-wear properties. Results of this test are given in Table III.

For comparison, the hydrocarbonaceous product used as feed for the experiment, described in Example 1, was blended with TPS 20, a polysulfide additive containing 20% by weight sulfur, in such an amount as to reach the same percentage by weight of sulfur in this blend as in the polar sulfur-containing lubricating base oils. The results of these tested blends have been incorporated in Table III as well.

TABLE III

| Experiments | 2 | 5 |
|---|---|---|
| % by weight S (measured after stripping) | 0.67 | 0.31 |
| 4 balls wearscar diameter (mm) | 0.44 | 0.41 |
| Hydrocarb. prod. blended with TPS 20 | 0.66 | 0.57 |

It can be seen that the polar lubricating base oils prepared in accordance with the present invention have very good anti-wear properties at relatively low contents of sulfur. The anti-wear properties of the blend containing the anti-wear additive TPS 20, were worse for experiments 2 and 5.

What is claimed is:

1. A process for the preparation of a polar lubrication base oil, comprising reacting, without the aid of a free-radical generating catalyst, a hydrocarbonaceous product with a polar compound having enophilic properties, comprising at least one heteroatom, wherein said polar compound is selected from the groups consisting of a compound of the general formulae (I) to (IV)

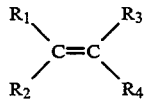

(I)

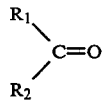

(II)

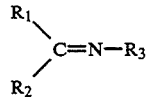

(III)

$R_1—C≡C—R_3$ (IV)

wherein, $R_1$, $R_2$, $R_3$, and $R_4$, each independently represents a hydrogen, alkyl, alkenyl, alkynyl, aryl or aralkyl, provided that in structures (I) and (IV) at least one of $R_1$, $R_2$, $R_3$, and $R_4$, additionally contains at least one heteratom;

and which hydrocarbonaceous product has been prepared by contacting hydrocarbons with an active-hydrogen containing system by a process which comprises generating a hydrogen-containing plasma and allowing contact of the hydrocarbons in liquid form with the plasma-generated system and recovering the hydrocarbonaceous product.

2. The process according to claim 1, wherein the polar compound is chosen from the group of compounds of the general formula (I).

3. The process according to claim 1, wherein the polar compound is selected from the group consisting of the compounds having the general formula (V)

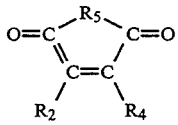

(V)

wherein $R_2$, and $R_4$, each independently represents a hydrogen, alkyl, alkenyl, alkynyl, aryl or aralkyl, and $R_5$ represents oxygen or the group N—A, wherein A is hydrogen, alkyl, aryl, amino or polyamino, and compounds having the general formula (VI):

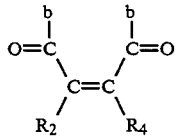

(VI)

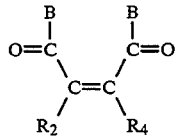

(VI)

wherein b represents hydrogen, alkyl, aryl, OH, amino or polyamino, or the group O—D, wherein D represents alkyl, aryl, amino, or polyamino.

4. The process according to claim 3, wherein the polar compound is maleic anhydride, or maleic acid esters, amides, or imides.

5. The process according to claim 1, wherein said reaction is at a temperature from about 100° C. to about 240° C. and at a reaction time from about 4 hours to about 30 hours.

6. The process according to claim 1, wherein the polar lubricating base oil comprises up to 10% by weight of the polar compound.

7. The process according to claim 1, wherein the polar lubricating base oil is further reacted with a functional compound containing oxygen, sulfur, and/or nitrogen heteroatoms.

8. The process according to claim 7, wherein the functional compound is an amine, imine, hydrazine, hydrazone, amide, or imide.

9. The process according to claim 7, wherein the functional compound is chosen from polyamines of the general formula (VII):

$$X_2N-[R_{(1\ to\ m)}-NX]_m-X \quad \text{(VII)}$$

wherein each $R_{(1\ to\ m)}$ is selected from an alkylene group or alkenylene and is chosen from $C_nH_{(2n-2p)}$, wherein n ranges from 1 to 10, p represents the degree of unsaturation and p equals 0 for an alkylene group and p equals 1 for an alkenylene group, m ranges from 2 to 10, X is hydrogen.

10. The process according to claim 9, wherein in the polyamine of formula (VII), n ranges from 2 to 4.

11. The process according to claim 7, wherein the functional compound is elemental sulfur, thiols, sulfides, polysulfides, or thiophenes.

12. The process according to claim 7, wherein the functional compound is selected from the group consisting of ketones, aldehydes, organic hydroxides, esters, and ethers.

13. The process according to claim 7, wherein the functional compound is selected from the group consisting of boric acid, boric esters, thiodiazoles, and thioamines.

14. The process according to claim 1, wherein the polar lubricating base oil is hydrogenated at a temperature from 20° C. to about 450° C. and a hydrogen partial pressure of from about 5 bar absolute to about 80 bar absolute, in the presence of a hydrogenation catalyst.

15. A process for the preparation of a polar lubricating base oil, comprising:

(a) reacting, without the aid of a free-radical generating catalyst, at a temperature from about 100° C. to about 240° C. and at a reaction time from about 4 hours to about 30 hours, a hydrocarbonaceous product with a polar compound having enophilic properties, selected from the group consisting of maleic anhydride, maleic acid esters, amides, and imides;

(1) which hydrocarbonaceous product has been prepared by contacting hydrocarbons with an active-hydrogen containing system by a process which comprises generating a hydrogen-containing plasma and allowing contact of the hydrocarbons in liquid form with the plasma-generated system;

(b) recovering a polar lubricating base oil; and (c) further reacting said polar lubricating base oil with a functional compound selected from the group consisting of an amine, imine, hydrazine, hydrazone, amide, and imide.

* * * * *